US009209536B2

(12) United States Patent
Hara

(10) Patent No.: US 9,209,536 B2
(45) Date of Patent: Dec. 8, 2015

(54) MOUNTING STRUCTURE FOR BOARD CONNECTOR

(71) Applicant: Sumitomo Wiring Systems, Ltd., Yokkaichi (JP)

(72) Inventor: Teruo Hara, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 14/468,430

(22) Filed: Aug. 26, 2014

(65) Prior Publication Data

US 2015/0064965 A1 Mar. 5, 2015

(30) Foreign Application Priority Data

Aug. 30, 2013 (JP) ..... 2013-178891

(51) Int. Cl.

| | |
|---|---|
| ***H01R 12/70*** | (2011.01) |
| *H01R 13/46* | (2006.01) |
| *H01R 13/631* | (2006.01) |
| *H01R 13/74* | (2006.01) |
| *H01R 13/508* | (2006.01) |
| *H01R 12/57* | (2011.01) |
| *H01R 13/627* | (2006.01) |

(52) U.S. Cl.

CPC ..... *H01R 12/7023* (2013.01); *H01R 12/57* (2013.01); *H01R 12/7005* (2013.01); *H01R 12/7047* (2013.01); *H01R 13/46* (2013.01); *H01R 13/508* (2013.01); *H01R 13/627* (2013.01); *H01R 13/631* (2013.01); *H01R 13/743* (2013.01)

(58) Field of Classification Search

CPC ..... H01R 12/7023; H01R 12/7047; H01R 13/743; H01R 12/7005; H01R 13/631; H01R 12/57; H01R 13/508; H01R 13/627

USPC ..... 439/567

See application file for complete search history.

(56) References Cited

U.S. PATENT DOCUMENTS

| | | | | |
|---|---|---|---|---|
| 6,558,205 | B1 * | 5/2003 | Shi et al. | 439/676 |
| 2010/0068925 | A1 * | 3/2010 | Daily | 439/567 |

FOREIGN PATENT DOCUMENTS

| | | |
|---|---|---|
| JP | 2012-256477 | 12/2012 |

* cited by examiner

*Primary Examiner* — Abdullah Riyami
*Assistant Examiner* — Justin Kratt
(74) *Attorney, Agent, or Firm* — Gerald E. Hespos; Michael J. Porco; Matthew T. Hespos

(57) ABSTRACT

A mounting portion (20) of a housing (10) is to be inserted into a circular mounting hole (2) formed on a circuit board (1) and has a fixed piece (21) and two resilient locking pieces (30) at substantially equal angular intervals. The fixed piece (21) has an arcuate outer surface (22A). Each resilient locking piece (30) has a displaceable main body (31) with an arcuate outer shape (33A) that conforms to the inner peripheral surface of the mounting hole (2). A lock (37) is on a tip of the main body (31) and can be locked to an edge on an under side of the mounting hole (2). An extending portion (33) is formed on each of side edges of the main body (31) and extends circumferentially toward the fixed piece (21).

3 Claims, 15 Drawing Sheets

MOUNTING STRUCTURE FOR BOARD CONNECTOR

BACKGROUND OF THE INVENTION

1. Field of the Invention

The invention relates to a structure for mounting a board connector on a circuit board.

2. Description of the Related Art

Japanese Unexamined Patent Publication No. 2012-256477 discloses a simple structure for mounting a housing of a board connector to a circuit board. This structure includes a mounting portion provided on a side surface of the housing and to be inserted into a circular mounting hole formed on the circuit board. The mounting portion has three insertion pieces at substantially equal angular intervals to have a circular plan view. One of the three insertion pieces is a fixed, but the remaining two are resiliently displaceable. The tip of each resilient locking piece has a locking portion that locks to a hole edge on an under side of the mounting hole.

The above mounting portion is so structured that, mainly due to a restriction on removal from a forming mold, there are three separate insertion pieces and only two insertion pieces are resilient locking pieces having a locking function. However, there is a possibility of detachment at the position of the fixed piece including no locking portion and further improvement has been desired to enhance a holding force.

The present invention was completed based on the above situation and aims to enhance a holding force of a housing onto a circuit board.

SUMMARY OF THE INVENTION

The invention is directed to a structure for mounting a housing of a board connector. Terminal fittings are mounted in the housing and are configured to be connected to a circuit board. A mounting portion is provided on a side surface of the housing and is configured to be inserted into a circular mounting hole formed on the circuit board. The mounting portion has a fixed piece and two resilient locking pieces at substantially at equal angular intervals about an axial center to define a circular locus in plan view. The fixed piece has an outer surface with an arcuate shape in conformity with the inner peripheral surface of the mounting hole. The fixed locking piece is formed by a first forming mold that moves along an axial direction of the mounting portion. The remaining two resilient locking pieces are resiliently displaceable and each has a main body and a lock on the tip of the main body. Each resilient locking pieces has an arcuate outer surface that conforms to the inner peripheral surface of the mounting hole and can be locked to an edge on an under side of the mounting hole. Each lock is formed by a second forming mold that moves along a direction facing the fixed piece of the mounting portion. An extending portion is formed on each side edge of the main body of each resilient locking piece and extends circumferentially toward the fixed piece on the axial center. Each extending portion is formed by the first forming mold.

The housing is mounted by aligning the mounting portion with the mounting hole of the circuit board and pushing the housing so that the two resilient locking pieces resiliently deform. The resilient locking pieces restore when the locks of the respective resilient locking pieces come out to the underside of the mounting hole. Thus, the locks are locked to the lower edge on the underside of the mounting hole, while the outer surface of the fixed piece is pressed against the inner peripheral surface of the mounting hole. Outer surfaces of the main bodies of the resilient locking pieces, including the extending portions, are pressed resiliently against the inner peripheral surface of the mounting hole substantially on an opposite side to retain the mounting portion.

The extending portions increase the circumferential areas that are pressed resiliently against the inner peripheral surface of the mounting hole of the circuit board to enhance a holding force.

Outer surfaces of the fixed piece and the extending portions of the main bodies of the resilient locking pieces may be formed with a rib along the axial direction.

Mold removal can restrict the formation position of the rib on the outer surface of the main body of the resilient insertion piece along the axial direction. However, the rib can be formed on the outer surface of the extending portion formed by the first mold. Thus, three ribs can be formed in a relatively well-balanced manner on a circumference and can exert a large pressing force to the inner peripheral surface of the mounting hole, for obtaining a larger holding force.

According to the invention, it is possible to mount a housing of a board connector on a circuit board with a larger holding force.

DETAILED DESCRIPTION

A board connector in accordance with an embodiment of the invention is a male connector as illustrated most clearly in FIGS. 1, 2 4, 6 and 10. The board connector of this embodiment includes a male housing 10 to be mounted on an end edge of a circuit board 1.

Figure 1:
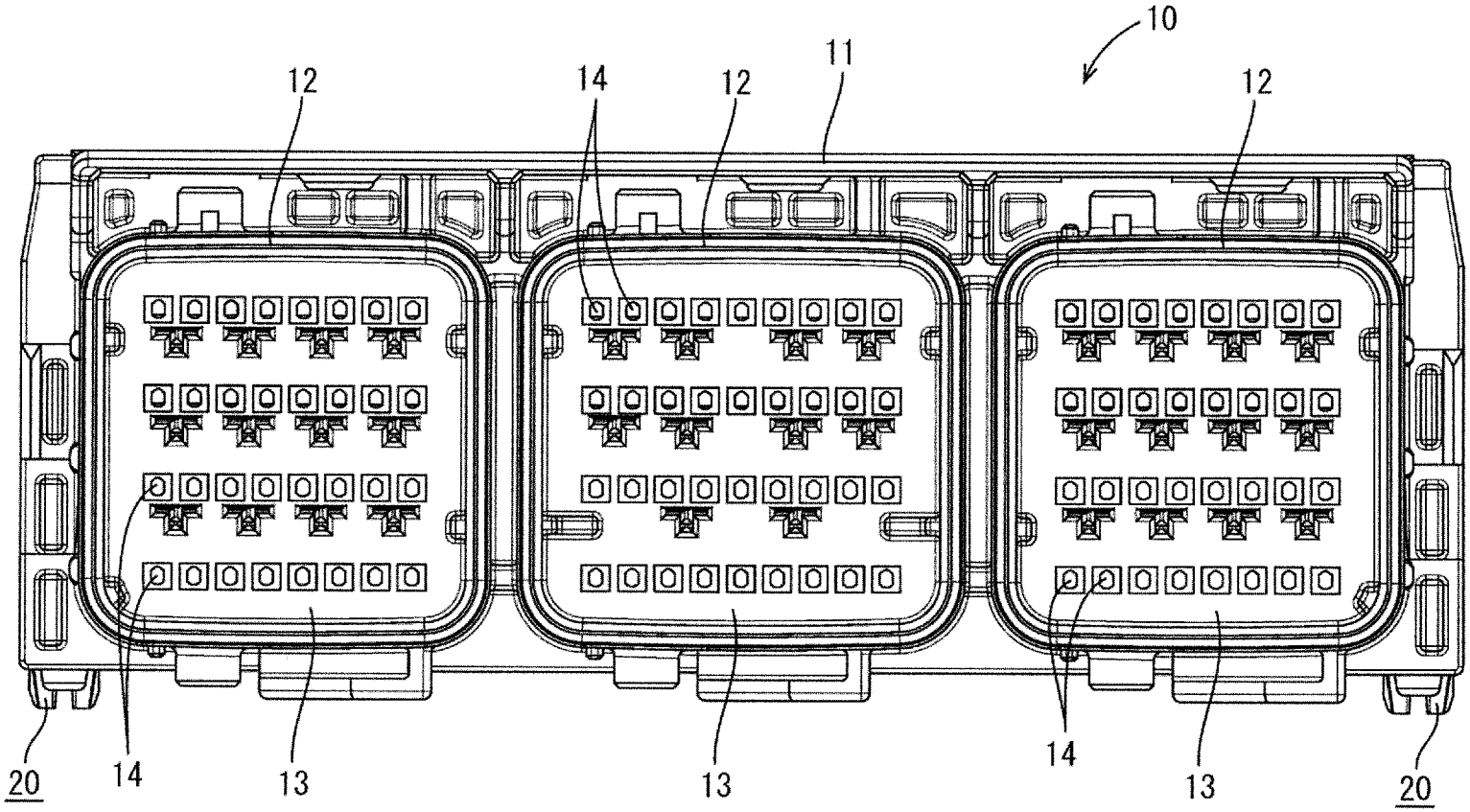
FIG. 1 is a front view of a housing according to one embodiment of the invention.
Figure 2:
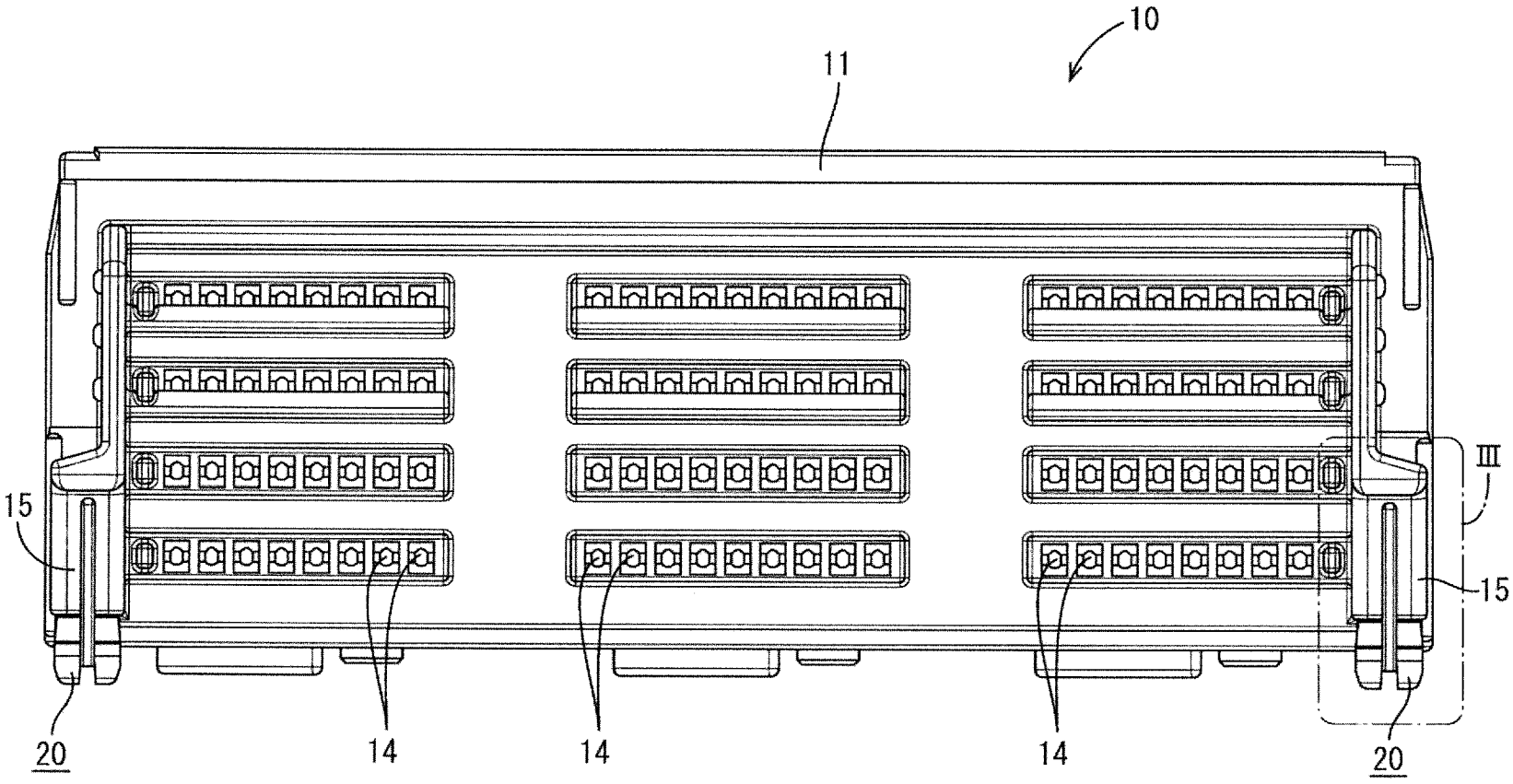
FIG. 2 is a rear view of the housing.
Figure 3:
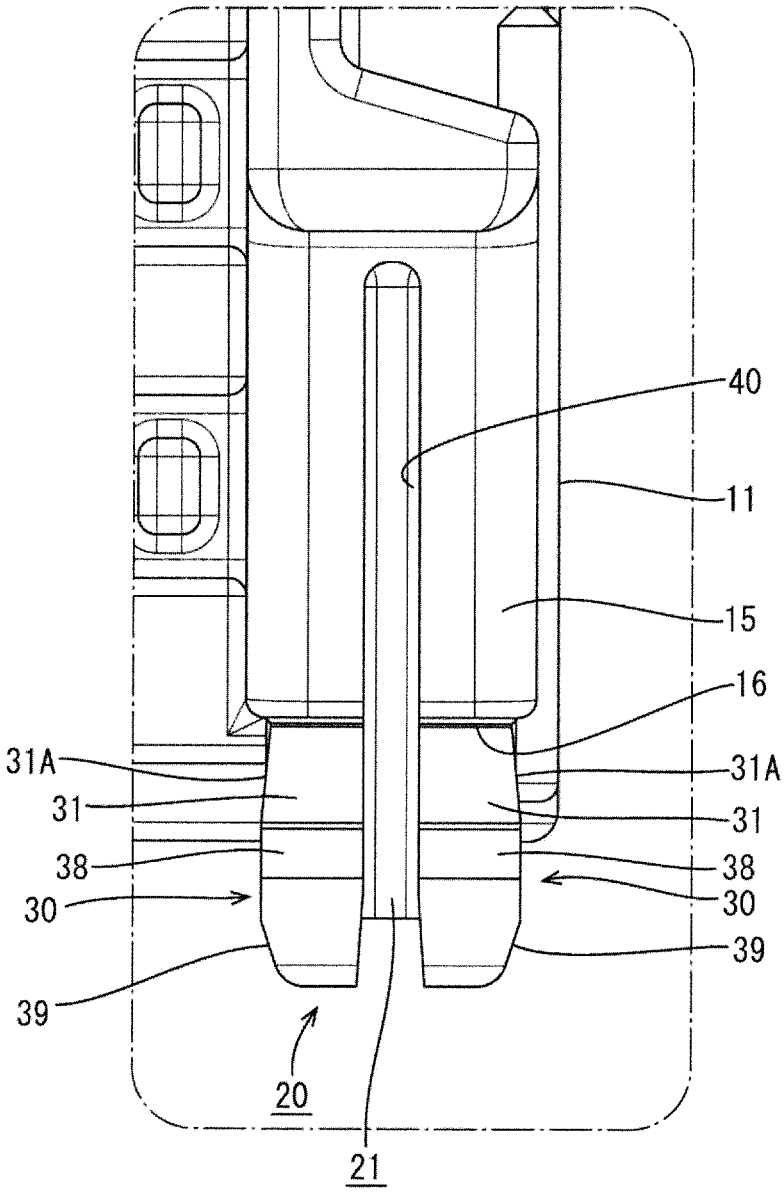
FIG. 3 is an enlarged view of a part III of FIG. 2.
Figure 4:
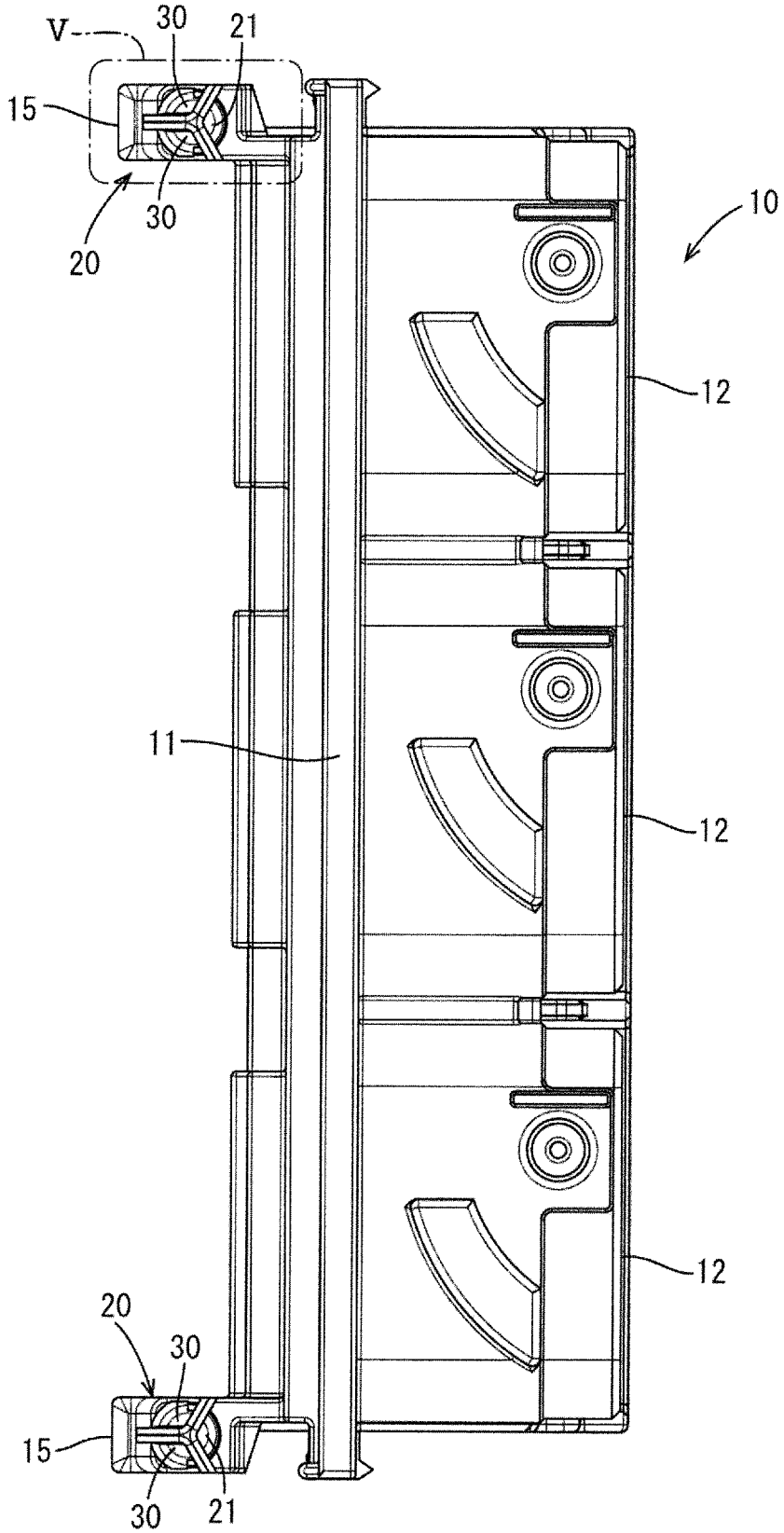
FIG. 4 is a bottom view of the housing.
Figure 6:
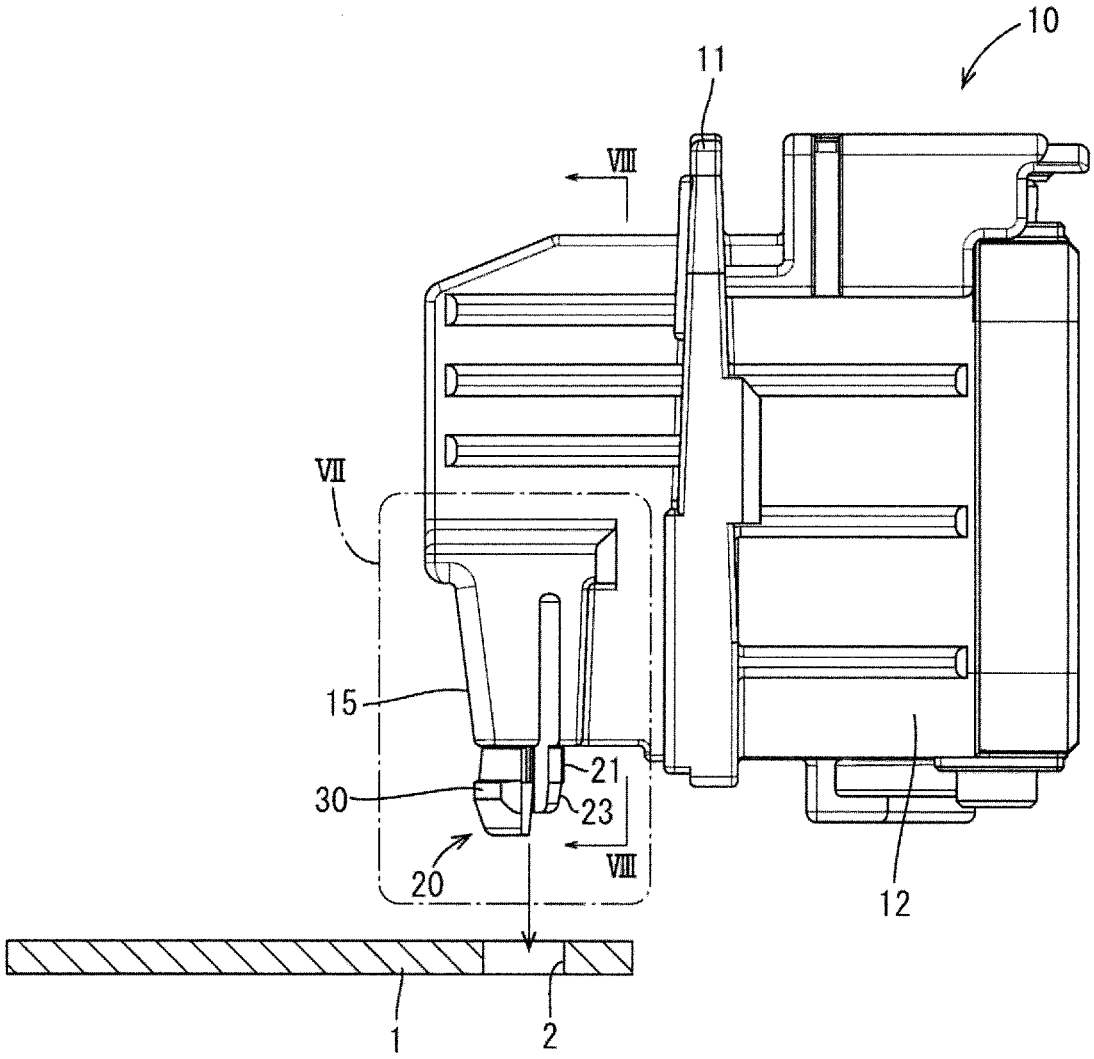
FIG. 6 is a side view showing an operation of mounting the housing on a circuit board.
Figure 10:
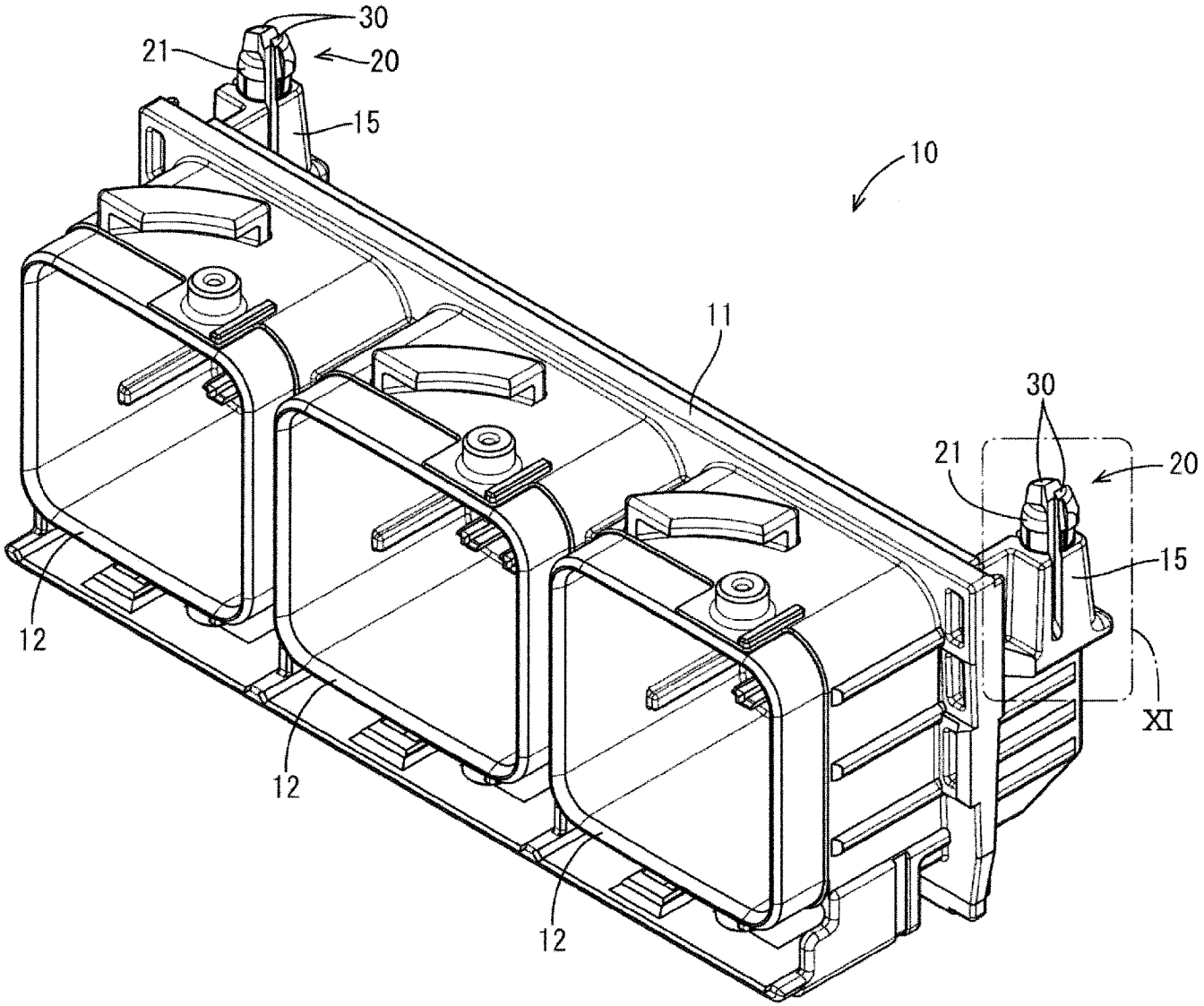
FIG. 10 is a perspective view of the housing in a vertically inverted state.
Figure 11:
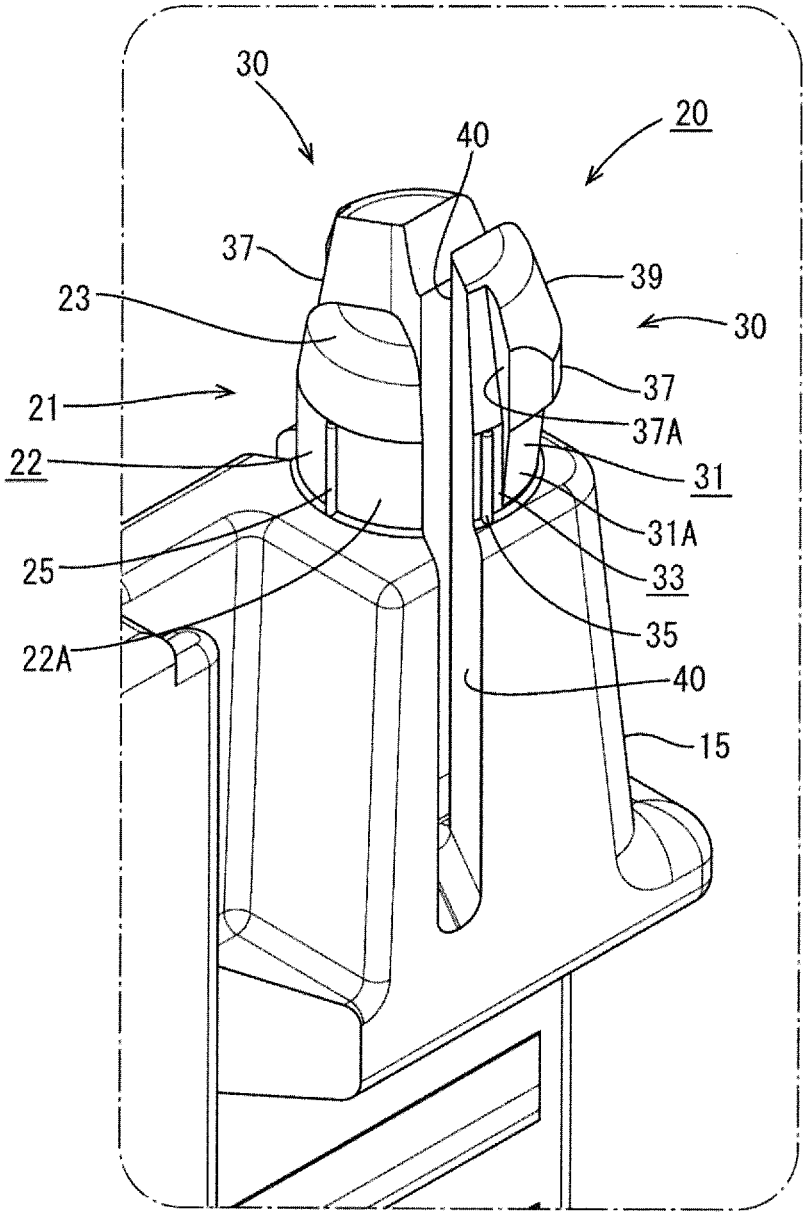
FIG. 11 is an enlarged view of a part XI of FIG. 10.

The male housing 10 is made of synthetic resin and, as shown in FIGS. 1, 6 and 10, has a base 11 in the form of a wide vertical plate. Three substantially rectangular receptacles 12 are arranged side by side in a lateral direction and project from a front surface of the base 11. In the following description, right and left sides of FIG. 6 are referred to as the front and rear.

Terminal insertion holes 14 are formed on a back wall 13 (base 11) of each receptacle 12. Although not shown, a male terminal bent into an L shape is mounted through each terminal insertion hole 14. A front part of each male terminal is aligned horizontally and projects in the receptacle 12, whereas a rear part hangs down at a right angle from a position behind the base 11 and the hanging end is inserted into a through hole formed on the circuit board 1 for connection.

A female housing (not shown) with female terminals is fit into each receptacle 12 of the male housing 10. The female housing is pulled into the receptacle 12 and connected by rotation of a mounted lever so that corresponding male and female terminals are connected.

As shown in FIGS. 2 to 11, downwardly extending mounting bases 15 protrude back at lower positions of opposite left and right end parts of the back surface of the base 11, and a mounting portion 20 to be inserted into a mounting hole 2 formed on the circuit board 1 projects down from the lower surface of each mounting base 15. The mounting hole 2 of the circuit board 1 is circular hole and two mounting holes 2 are formed at opposite sides of a formation area for the through holes.

Figure 5:
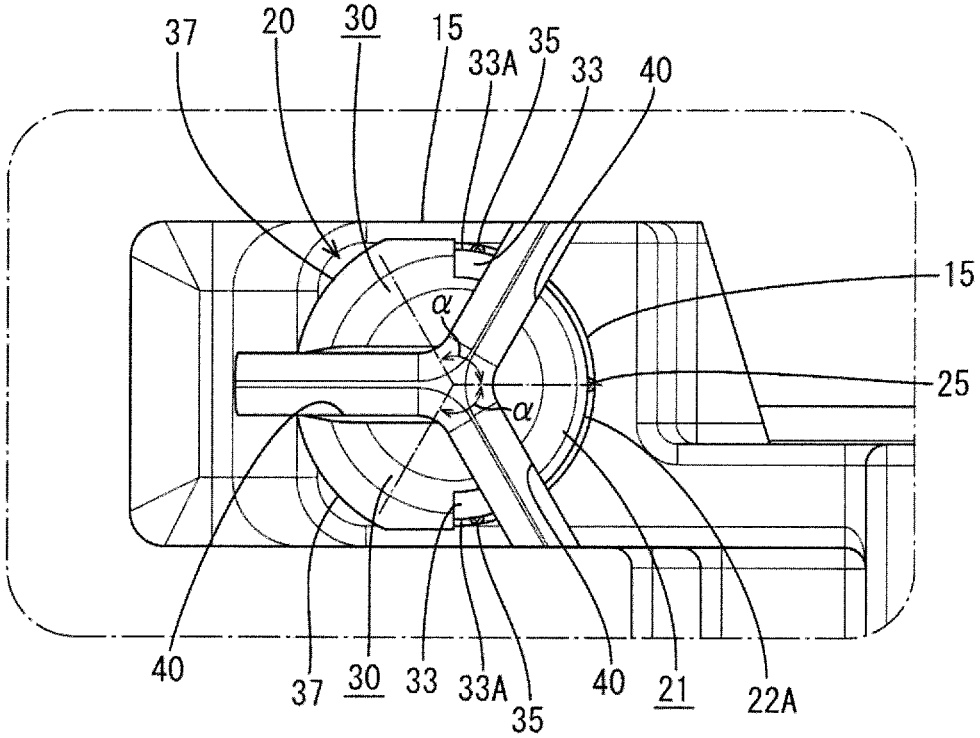
FIG. 5 is an enlarged view of a part V of FIG. 4.

The mounting portion 20 has three insertion pieces formed in the center of the lower surface of the mounting base 15 and arranged at predetermined angular intervals along a periphery of a disk-shaped base 16. More specifically, as shown in FIG. 5, a fixed insertion piece 21 is formed at a front position (right side of FIG. 5) of the periphery of the base 16 and resilient locking pieces 30 are formed at each of left and right rear positions oblique to and spaced backward by 120° ($\alpha$) from the front edge position.

Figure 7:
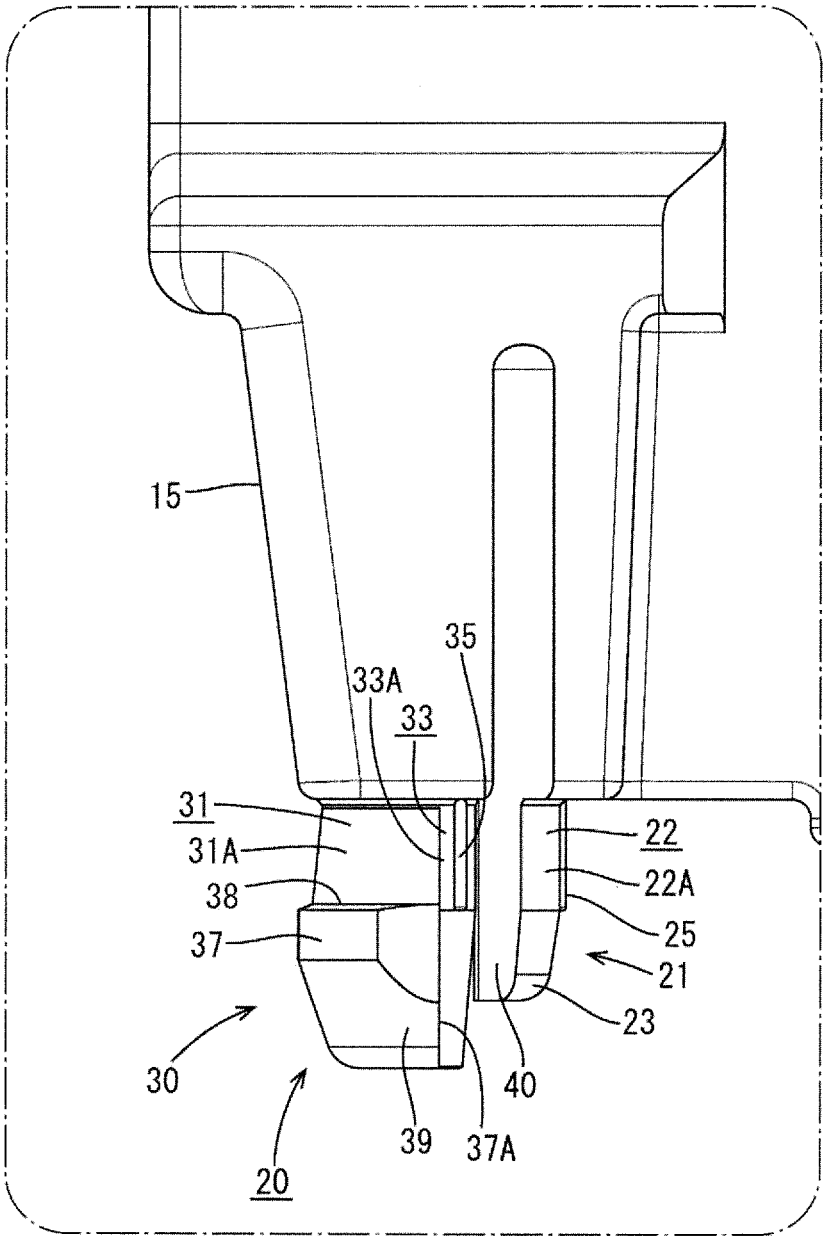
FIG. 7 is an enlarged view of a part VII of FIG. 6.

The fixed piece 21 has a fan-shaped cross-section with a center angle of 120° and an extending length that is about twice as long as the thickness of the circuit board 1 as shown in FIG. 6. As shown in FIGS. 5 and 7, the fixed piece has a base portion 22 with a length slightly greater than the thickness of the circuit board 1 and an arcuate outer surface 22A conforms to the inner peripheral surface of the mounting hole 2 in a circumferential direction. An inclined guide surface 23 is formed at the free end of the fixed piece 21.

A short rib 25 having a substantially semicircular cross-section is formed at a widthwise center position of the arcuate outer surface 22A of the base portion 22 of the fixed piece 21.

Each resilient locking piece 30 has a fan-shaped cross-section with a center angle of 120° and an extending length longer than the fixed piece 21 by a predetermined dimension. A lock 37 is formed near the free end of the resilient locking piece 30.

Each resilient locking piece 30 has a main body 31 adjacent the mounting base 15. The main bodies 31 have lengths substantially equal to the length of the base portion 22 of the fixed piece 21. Thus, the extending end of the an extending end of the main body 31 is located on the same plane as the extending end of the outer surface of a base portion 22 of the fixed piece 21. Additionally, the main bodies 31 have arcuate outer surfaces 31A that conform to the inner peripheral surface of the mounting hole 2 in the circumferential direction. The outer surface 31A is tapered so that the diameter is gradually increased at positions farther from the mounting base 15 as shown in FIG. 7.

Extending portions 33 are formed over an angle range of 30° on sides of the main bodies 31 of the respective resilient locking pieces 30 separated from each other and extend circumferentially toward the fixed piece 21. An outer surface 33A of the extending portion 33 is arcuate to conform with the inner peripheral surface of the mounting hole 2 in the circumferential direction and hence has the same diameter as the vertical portion 22 of the fixed piece 21. A short rib 35 having a substantially semicircular cross-section is formed at a widthwise center position of the arcuate outer surface 33A of the extending portion 33 (see FIGS. 7 and 13).

An upper side of the lock 37 formed on the lower end of the resilient locking piece 30 has a substantially mountain-shaped cross-section projecting in a radial direction, the upper surface of the locking 37 defines a locking surface 38 to be locked to an edge on an under side of the mounting hole 2 of the circuit board 1 and the lower inclined surface defines a guide surface 39.

A part 37A of the lock 37 that includes the locking surface 38 is cut off at a position below the extending portion 33. Thus, the locking surface 38 is provided only at a position below the piece main body 31.

The one fixed piece 21 and the two resilient locking pieces 30 described above are have with grooves 40 formed therebetween, as shown in FIG. 5. Each groove 40 extends up to an upper end part of the mounting base 15.

Figure 12:
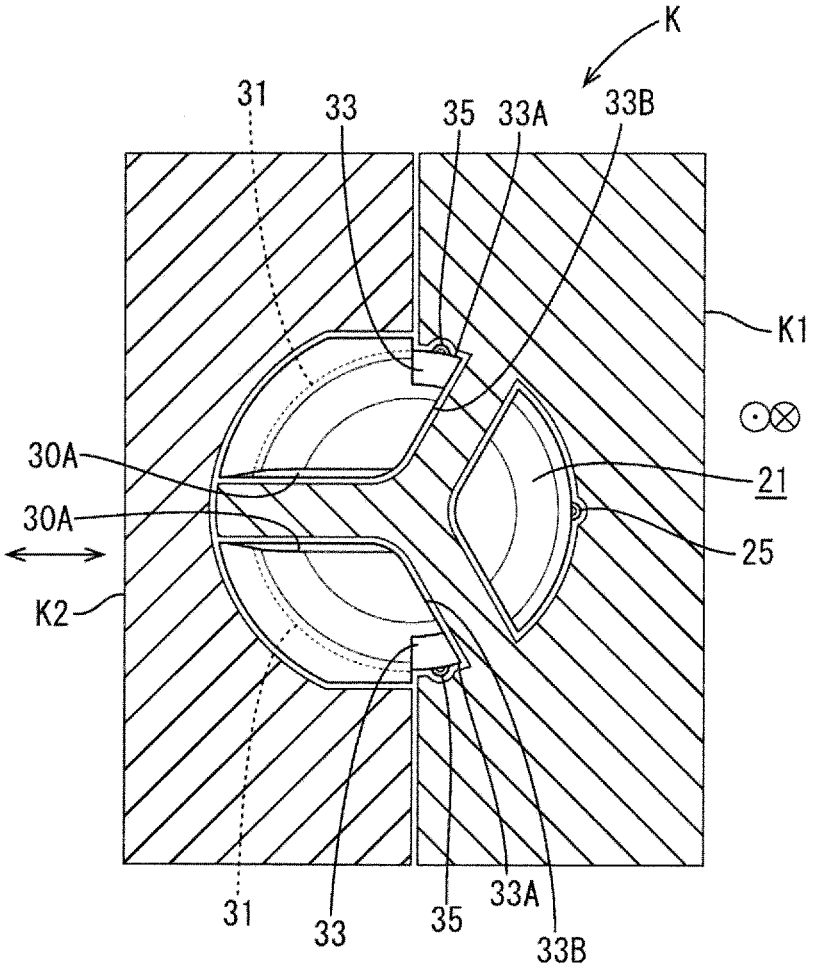
FIG. 12 is a section showing the shape of a forming mold for a mounting portion.

The mounting portion 20 is molded in a forming mold K as shown in FIG. 12.

The outer surfaces 31A of the main bodies 31 and the outer surfaces of the locks 37 of the two resilient locking pieces 30 can be molded by a rear forming mold K2 out of front and rear forming molds for molding the male housing 10 including the mounting portions 20.

The entire peripheral surface of the fixed piece 21 including the rib 25, the adjacent side surfaces 30A of the resilient locking pieces 30, the outer surfaces 33A of the extending portions 33 including the ribs 35 and the side surfaces 33B of the extending portions 33 are molded by a slide mold K1 movable in a vertical direction perpendicular to the plane of FIG. 12.

Neither the fixed piece 21 nor the resilient locking pieces 30 have an undercut part for the slide mold K1, and hence they are not forcibly removed from the mold.

Figure 8:
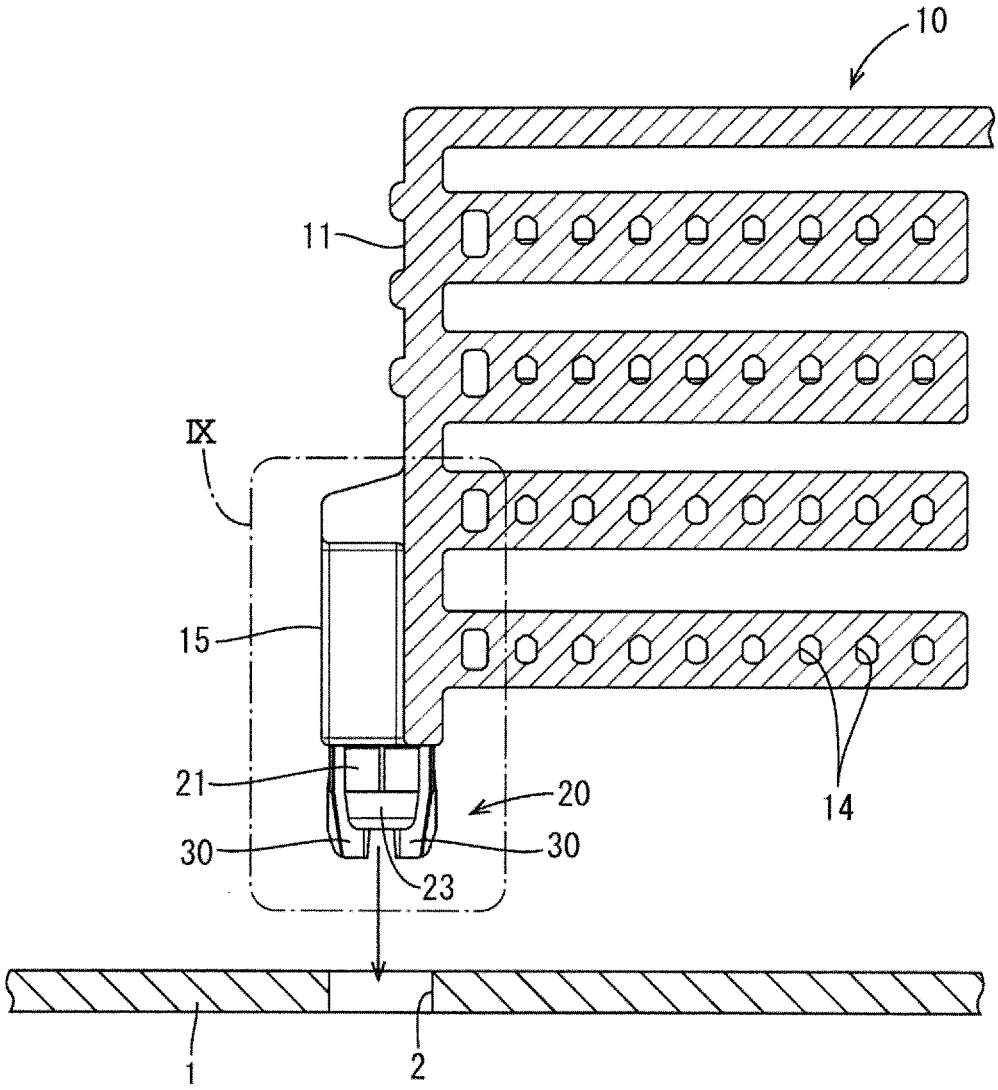
FIG. 8 is a section along VIII-VIII of FIG. 6 showing the operation of mounting the housing on the circuit board.
Figure 9:
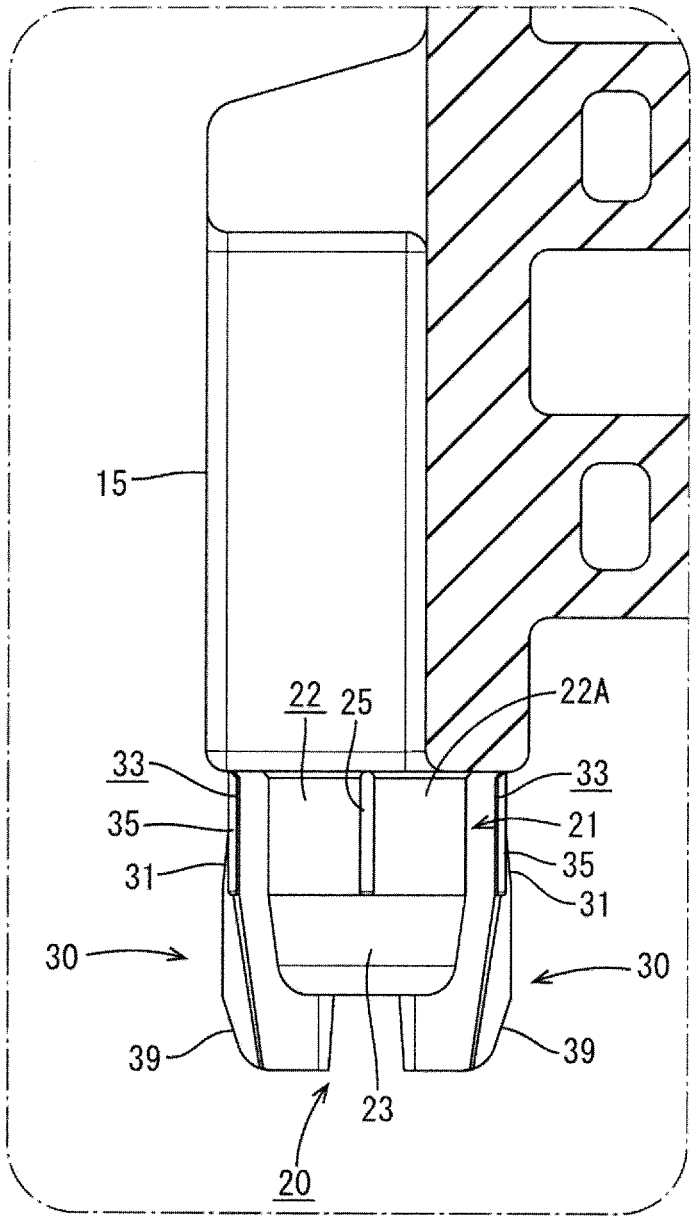
FIG. 9 is an enlarged view of a part IX of FIG. 8

The two mounting portions 20 extend down on the opposite left and right end parts of the back surface of the male housing 10 and are inserted into the corresponding mounting holes 2 formed on the circuit board 1 as shown by arrows of FIGS. 6 and 8 when mounting the male housing 10 on the circuit board 1.

The guide surfaces 39 of the locks 37 of the two resilient locking pieces 30 initially contact an edge on a top side of the mounting hole 2, and the fixed piece 21 is guided by the guide surface 23 to be pushed into the mounting hole 2 while the resilient locking pieces 30 are resiliently displaced inwardly.

Figure 13:
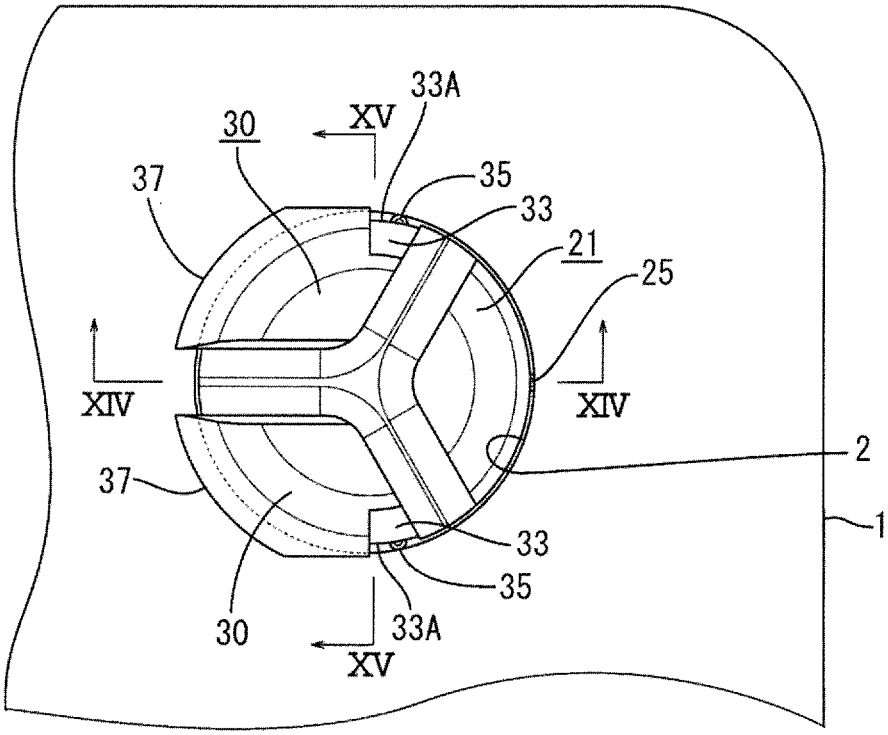
FIG. 13 is a bottom view showing a state where the mounting portion is fitted in a mounting hole.
Figure 14:
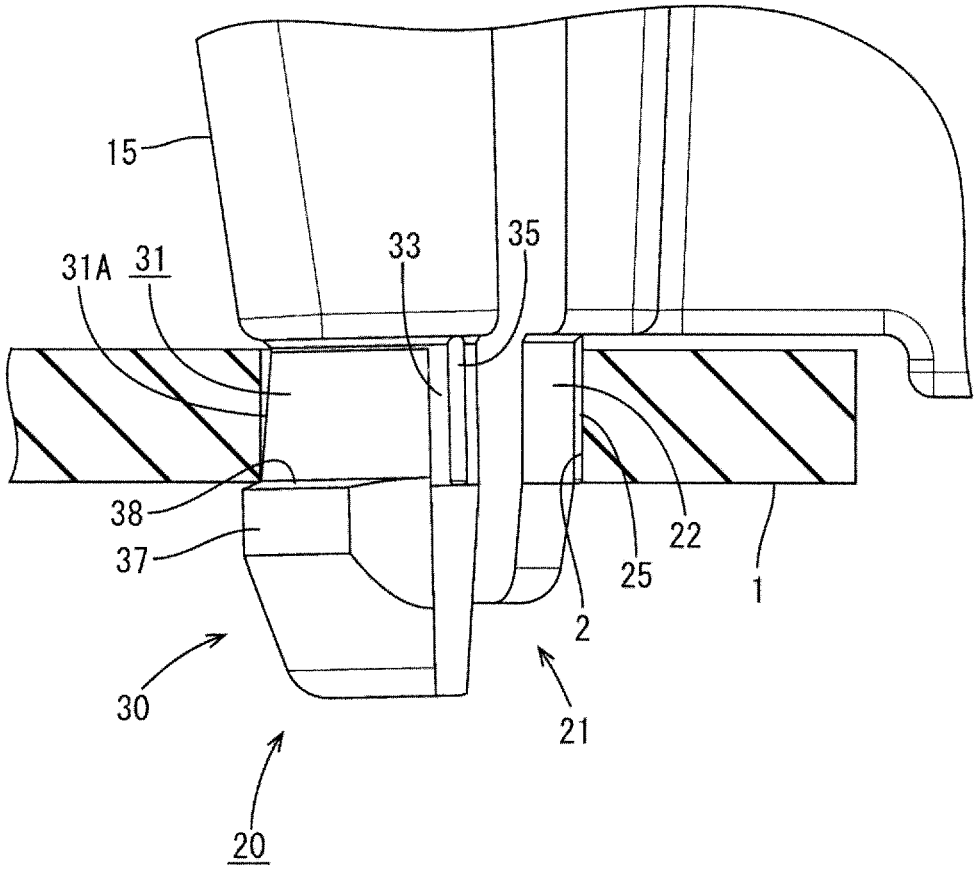
FIG. 14 is a section along XIV-XIV of FIG. 13.
Figure 15:
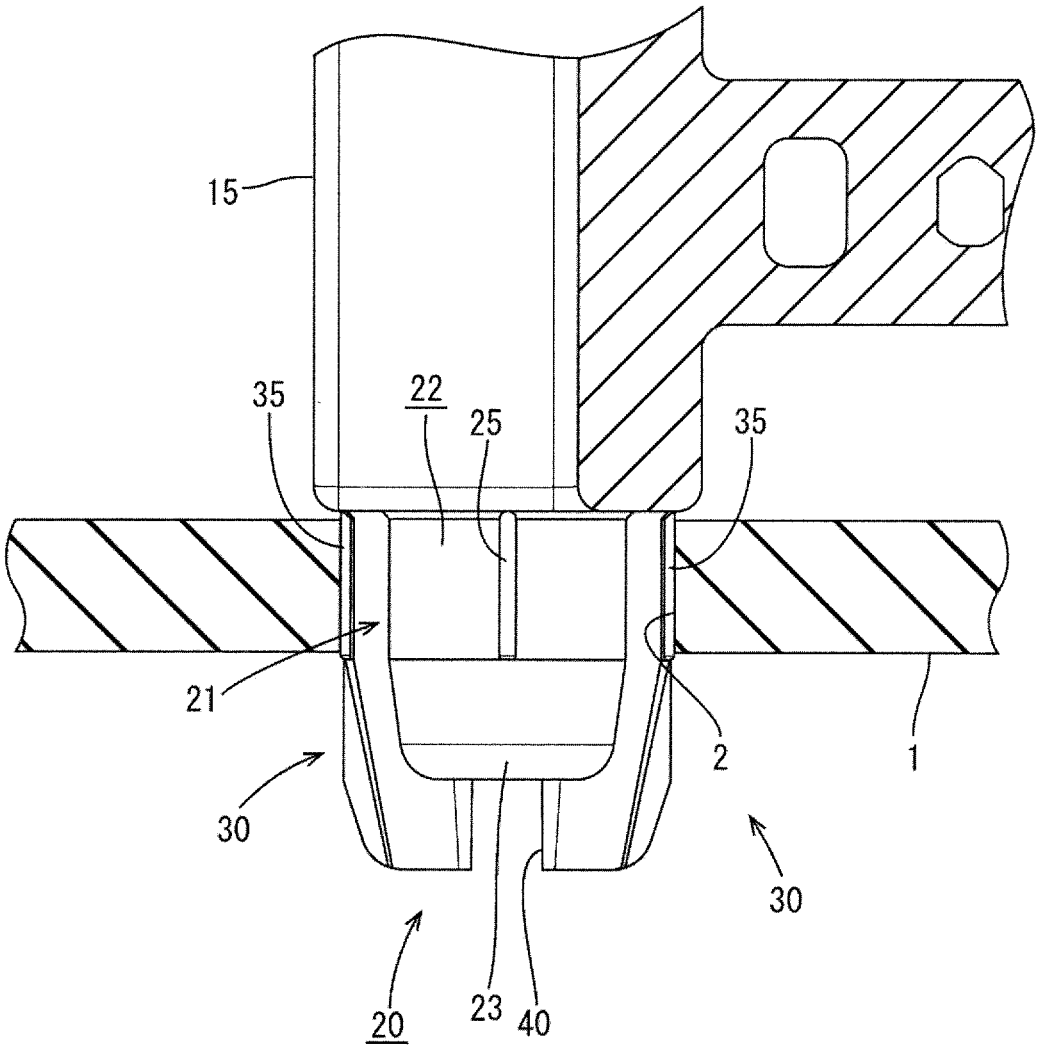
FIG. 15 is a section along XV-XV of FIG. 13.

The male housing 10 is pushed until the lower surfaces of the mounting bases 15 contact the upper surface of the circuit board 1. At this time, the locks 37 of the resilient locking pieces 30 come out to the under side of the mounting hole 2. Thus, the resilient locking pieces 30 restore, and the locks 37 are locked to the hole edge on the underside of the male housing 2 and, while the rib 25 of the outer surface 22A of the fixed piece 21 is pressed against the inner peripheral surface of the mounting hole 2 on a front side, the outer surfaces 31A of the main bodies 31 of both resilient locking pieces 30 are pressed resiliently against the inner peripheral surface of the mounting hole 2 on a substantially opposite side as shown in FIGS. 13 to 15. At this time, the outer surfaces 33A of the extending portions 33 of the main bodies 31 of the resilient locking pieces 30 are in a state floating (separated) from the inner peripheral surface of the mounting hole 2, but the ribs 35 provided on the outer surfaces 33A of the extending portions 33 fill up gaps and are resiliently pressed against the inner peripheral surface of the mounting hole 2.

The mounting portions 20 are held in the mounting holes 2, and the male housing 10 is retained and mounted in a proper posture on the circuit board 1. During this time, downward facing rear ends of the male terminals arranged in rows in the male housing 10 are inserted into the corresponding through holes formed on the circuit board 1 and, then, are soldered.

Thus the rear ends of the male terminals are fixed while being electrically connected to the corresponding through holes (conductive parts).

According to this embodiment, the extending portions 33 are provided on the side edges of the main bodies 31 of the two resilient locking pieces 30 of the mounting portion 20 and the ribs 35 stand on the outer surfaces 33A of the extending portions 33. Thus, circumferential areas resiliently pressable against the inner peripheral surface of the mounting hole 2 of the circuit board 1 can be increased and, consequently, a force for holding the mounting portion 20 in the mounting hole 2 can be enhanced.

Further, a large pressing force is obtained by the ribs. In this embodiment, the rib 25 of the fixed piece 21 and the ribs 35 of the two resilient locking pieces 30, i.e. a total of three ribs arranged in a relatively well-balanced manner on a circumference can exert a large pressing force to the inner peripheral surface of the mounting hole 2. Thus, a larger holding force can be obtained.

The invention is not limited to the above described and illustrated embodiment. For example, the following embodiments also are included in the scope of the invention.

Although the arcuate outer surface of the main body of the resilient locking piece is tapered in the axial direction so that the diameter gradually increases toward the lower edge in the above embodiment, the outer surface may extend vertically so as to have a constant diameter over the entire height.

In that case, the outer surface of the extending portion provided on the side edge of the piece main body may be also an arcuate surface having the same diameter and the rib, which functions as a gap filling portion, may be omitted.

The center angle of 120° illustrated above for the fixed piece and the resilient locking pieces of the mounting portion to have a substantially fan-shaped cross-section is only an example and another center angle may be adopted.

LIST OF REFERENCE SIGNS

1 . . . circuit board
2 . . . mounting hole
10 . . . male housing (housing)
15 . . . mounting base
20 . . . mounting portion
21 . . . fixed piece (insertion piece)
22 . . . vertical portion
22A . . . outer surface (of vertical portion 22)
25 . . . rib
30 . . . resilient locking piece (insertion piece)
31 . . . piece main body
31A . . . outer surface (of piece main body 31)
33 . . . extending portion
33A . . . outer surface (of extending portion 339
35 . . . rib
37 . . . locking portion
K1 . . . slide mold (first forming mold)
K2 . . . rear forming mold (second forming mold)

What is claimed is:

1. A mounting structure for mounting a housing of a board connector to a circuit board, comprising:

a mounting portion provided on a side surface of the housing and configured to be inserted into a circular mounting hole formed on the circuit board, the mounting portion including:

a fixed piece having an arcuate outer surface conforming to an inner peripheral shape of the circular mounting hole; and two resiliently displaceable resilient locking pieces each including a main body and a lock provided on a tip of a main body, the main body having an arcuate surface conforming to the inner peripheral shape of the mounting hole to be locked to an edge on an under side of the mounting hole; and an extending portion formed on a side edge of each of the main bodies of the resilient locking pieces and extending circumferentially toward the fixed piece.

2. The mounting structure for a circuit board of claim 1, wherein the fixed piece and the resilient locking pieces extend through substantially equal angles around a center axis of the mounting portion.

3. The mounting structure for a circuit board of claim 1, wherein the outer surface of the fixed piece and the outer surfaces of the extending portions of the main bodies of the respective resilient locking pieces are formed with ribs along an axial direction of the mounting portion.

* * * * *